United States Patent [19]

Huber et al.

[11] Patent Number: 5,066,529

[45] Date of Patent: Nov. 19, 1991

[54] CAMOUFLAGE WRAPPING TAPE

[75] Inventors: Charles D. Huber; Donald J. Barry, both of St. Paul, Minn.

[73] Assignee: Minnesota Mining and Manufacturing Company, St. Paul, Minn.

[21] Appl. No.: 587,753

[22] Filed: Sep. 24, 1990

[51] Int. Cl.[5] ..... B32B 3/00

[52] U.S. Cl. ..... 428/40; 428/246; 428/248; 428/343; 428/906; 428/919

[58] Field of Search ..... 428/40, 246, 248, 343, 428/906, 919

[56] References Cited

U.S. PATENT DOCUMENTS

| | | | |
|---|---|---|---|
| D. 297,596 | 9/1988 | Marquart, Sr. | 428/919 |
| 4,557,965 | 12/1985 | Karlsson | 428/919 |
| 4,606,966 | 8/1986 | Karlsson | 428/919 |
| 4,748,061 | 5/1988 | Vesley | 428/919 |
| 4,749,612 | 6/1988 | Borkowski et al. | 428/246 |

*Primary Examiner*—Patrick J. Ryan

*Attorney, Agent, or Firm*—Gary L. Griswold; Walter N. Kirn; Mark A. Litman

[57] ABSTRACT

A comouflage wrapping tape is provided with elongated patterns which define an angle different from perpendicular to the edges. The tape can be wrapped around small diameter articles to provide a verticle appearance to the pattern.

18 Claims, 1 Drawing Sheet

CAMOUFLAGE WRAPPING TAPE

BACKGROUND OF THE INVENTION

1. Field of the Invention

The present invention relates to camouflage wrapping tape and in particular to camouflage wrapping tape which can be applied to small or moderate diameter objects.

2. Background of the Art

Camouflage is used to reduce the ability of the person or object wearing the camouflage to be seen by animals or instrumentation. Camouflage appears in many natural forms in the animal world, both on land and in the sea. Humans have attempted many different camouflage techniques for both hunting and military purposes. Many different structures and designs have been developed for camouflage including body wrap strips for hunters (e.g., U.S. Pat. No. 4,792,471), seam tape having artificial leaf constructions thereon (e.g., U.S. Pat. No. 4,517,230), and fabrics to be lain over the article to be masked (e.g., U.S. Pat. No. 4,243,709 and 3,977,927). The camouflage may be applied to persons or animals, or it may be applied to or over articles.

When prior types of camouflaging materials were to be applied to small diameter objects such as bows, rifle barrels, stand supports, and the like, vague, blotchy patterns without natural shapes and direction had to be used. If the camouflage pattern had distinct natural shapes and linear orientation, the materials were not easily applied in a manner that allow the original camouflage markings or patterns to appear in a satisfactory camouflaging pattern. Such patterns had to be cut into sections to wrap around the object to be hidden.

SUMMARY OF THE INVENTION

A tape is provided which has an elongated pattern on at least one surface, the pattern being at an angle with respect to the edge of the tape which is between 15° and 80°. The tape can be wrapped around a small diameter object with the successive edge windings of the tape causing the edges to either abut or overlap, while the pattern on the tape remains approximately parallel to the long axis of the small diameter object. The tape may have adhesive thereon to secure it to the object.

DESCRIPTION OF THE DRAWINGS

Figure 1:
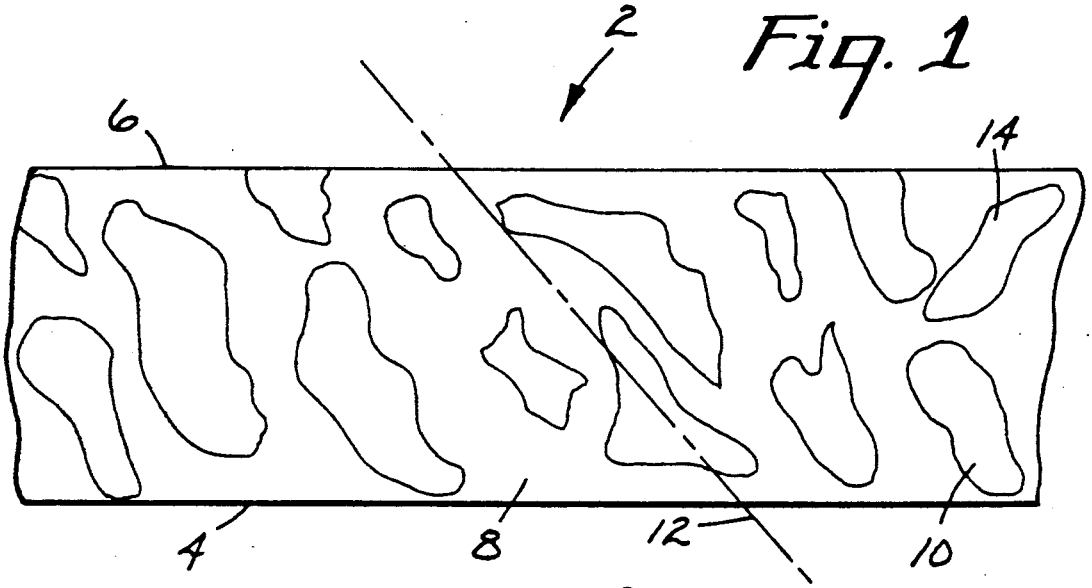
FIGS. 1 and 2 show camouflage tapes having markings disposed according to the present invention.

FIG. 1 shows a camouflage tape 2 having two parallel sides 4 and 6. On the tape 2 is a background color area 8 of a first color. On the background color area 8 is a pattern of elongated areas 10 in a color different from that of color area 8. The overall effect of all of the elongated areas (like 10) is to provide an impression of a pattern of angularity (12) to the elongated areas. Some of the elongated areas (e.g., 14) may have an angularity which deviates significantly from the impression of consistent angularity 12 without destroying the total effect.

Figure 2:
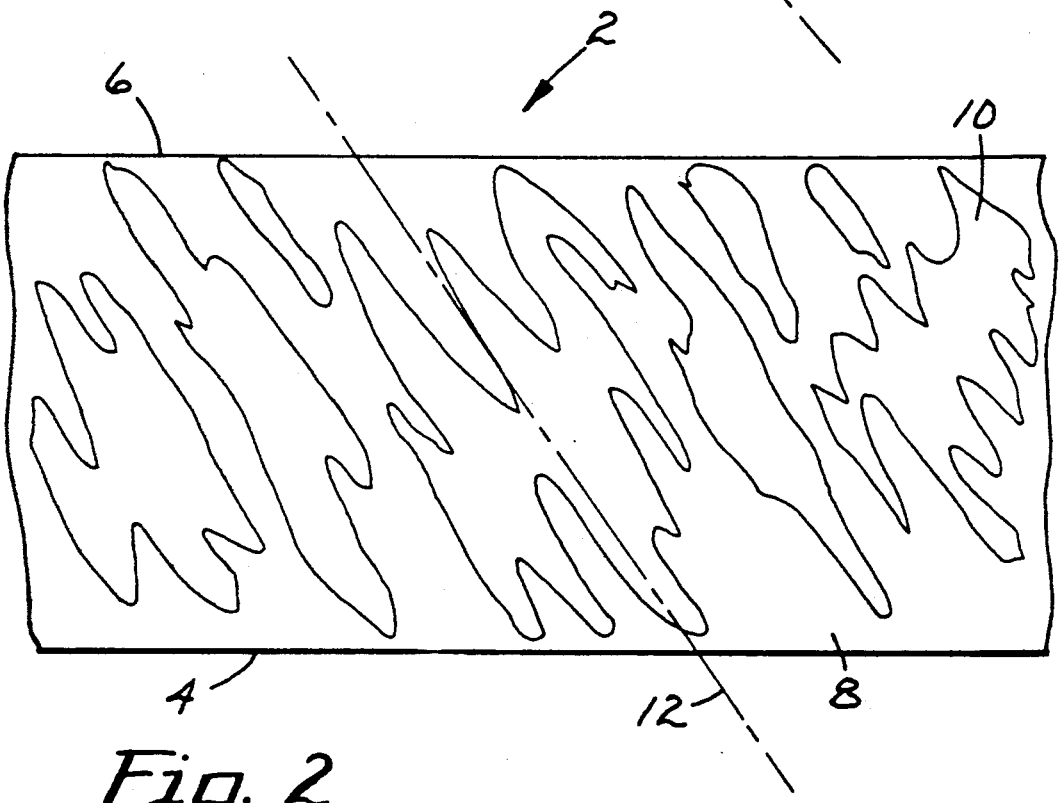

FIG. 2 shows a camouflage tape 2 having two parallel sides 4 and 6. On the tape is a background color area 8 of a first color. On the background color area 8 is a pattern of a different type of elongated areas 10 printed in a color different from that of the color of color area 8. Because of the nature of the type of mass used for the color area 10, the mass may appear to be longer in the dimension 12 which provides the appearance of angularity.

DETAILED DESCRIPTION OF THE INVENTION

A tape is provided with a pattern of elongated items on at least one surface. The pattern is designed so that the approximate axes of the elongated elements or items lie at an angle with respect to the long edge of the tape which is generally between 15° and 80°, preferably between 20° and 80°. The term 'elongated item' means an individual image portion which gives a visual impression of extending in one particular general direction. For example, a rectangle gives the appearance of extending in one direction while a circle or square does not. The shapes may look like patterns of bark on a tree (which tend to appear to run vertically up the tree), or cattail or grasses, oblong shapes, multiple fingerlike extensions from a bulk, a sinusoidal pattern, etc. The critical characteristic is that the apparent directionality of the shapes or pattern generally appears to be at an angle of between 15° and 80° to the long edge of the tape, generally with tapes between 1.5 and 20 cm wide. Preferably the apparent angularity is between 20° and 80°, more preferably between 40° and 80°. When the tape is wound about a thin diameter (between 1 and 20 cm diameter) article, the tape is generally started at an angle (down or up) with respect to the long axis of the article, and wound around the article. The winding is done so that the newly laid edge of the tape abuts or overlaps the edge of the previously laid winding of the tape. The angle of the winding, the degree of overlap, and the thickness of the article are balanced so that upon completion of the wrapping, the directional tendency of the elongated patterns or items appear to be aligned with the long axis of the article.

The pattern may be in any color (as some animals are color blind and only the patterns are observed), but preferably colors are selected which are capable of subtly blending into a natural background. Typical camouflage colors of brown, tan, khaki, green, olive, grey and black are preferred. The width of the tape and the angle of the directional appearance of the pattern may be varied to accommodate different diameter articles. Ordinarily, only articles of between 1 and 20 cm are to be easily wrapped according to the present invention. Preferably the invention is practiced on articles having diameters of 2 to 10 cm, more preferably 2 to 7 cm in diameter. The articles may be of any length, as from 5 cm to 20 m in length. The width of the tape is generally between 1.5 and 20 cm, preferably between 3 and 15 cm, more preferably between 3 and 10 cm. It is particularly desirable that the tape be flexible and especially desirable if the tape be elongatable (stretchy) so that irregularities in the article to be wrapped may be accommodated or the angle of the wrapping may be adjusted during the wrapping step. A particularly preferred material for the tape itself is the elastic shirred web material described in U.S. Pat. No. 3,575,782. Other materials which can be used include paper (e.g., crepe paper) with sufficient strength to be able to undergo the physical handling of wrapping, polymeric film, fabric (e.g., non-woven, knitted, woven, rubberized, etc.), and the like. The pattern may be printed, painted, woven into the fabric, dye transferred, or in any other way imposed on the tape material. The pattern may be placed on the tape itself or placed on a fabric or material from which the tape is cut. The tape may be bare backed or coated with a pressure-sensitive adhesive.

Example

A sheet of shirred elastic web product manufactured according to the examples of U.S. Pat. No. 3,575,782, incorporated herein by reference was provided. On the non-adhesive surface of the web was printed a camouflage pattern in brown, dark tan, and olive. The pattern comprised elongate brown nd dark tan striated masses on a tan background. The masses were elongate and generally produced a visual impression of an angle of twenty-five degrees from a line perpendicular to the long edges of the tape. The tape was rolled and then unrolled when wrapped about a one-inch diameter shotgun barrel. The tape was wrapped about the barrel at an angle close to the twenty-five degrees of the printed pattern. The tape was slightly overlapped to assure complete coverage of the barrel. After wrapping, the barrel appeared to have a linearly aligned camouflage pattern along the length of the barrel.

For camouflage purposes, it is desirable that the elongate patterns not give a firm appearance of stripes, running edge to edge in a fixed thickness (e.g., stripes) as this would provide a harsh, unnatural appearance in the wrapped article, appearing like uninterrupted stripes running vertically or horizontally along the length of the wrapped article. This would be so unnatural as to fail to act as camouflage. The patterns are preferably softer in their outlines than stripes, with rounded, curved features.

What is claimed is:

1. A camouflage tape capable of being repeatedly wrapped around an article having a diameter between 1 and 20 cm to provide a pattern giving an appearance of linearity with respect to the axis of said article perpendicular to a cross section of said article, said tape having a width of between 1.5 and 20 cm and having a colored image on at least one surface of said tape, said colored image comprising a background color having a pattern in a different color thereon, said pattern comprising elongate masses which provide the appearance of angularity with respect to the edges of the tape defining the width of said tape, the angularity giving an appearance of angles between 15° and 80° with respect to said edges.

2. The tape of claim 1 repeatedly wrapped about an elongate article having a diameter between 2 and 10 cm, said tape abutting or overlapping the previous winding of the tape so as to not leave the article exposed.

3. The tape of claim 1 wherein said background color and said color having a pattern are selected from the group consisting of brown, tan, khaki, green, olive, grey and black.

4. The tape of claim 1 wherein said elongate masses have rounded, curved features therein.

5. The tape of claim 2 wherein said elongate masses have rounded, curved features therein.

6. The tape of claim 3 wherein said elongate masses have rounded, curved features therein.

7. The tape of claim 2 wherein said elongate article has a diameter of between 2 and 7 cm.

8. The tape of claim 5 wherein said elongate article has a diameter of between 2 and 7 cm.

9. The tape of claim 1 wherein said angularity gives an appearance of angles between 40° and 80° with respect to said edges.

10. The tape of claim 2 wherein said angularity gives an appearance of angles between 40° and 80° with respect to said edges.

11. The tape of claim 3 wherein said angularity gives an appearance of angles between 40° and 80° with respect to said edges.

12. The tape of claim 4 wherein said angularity gives an appearance of angles between 40° and 80° with respect to said edges.

13. The tape of claim 5 wherein said angularity gives an appearance of angles between 40° and 80° with respect to said edges.

14. The tape of claim 6 wherein said angularity gives an appearance of angles between 40° and 80° with respect to said edges.

15. The tape of claim 7 wherein said angularity gives an appearance of angles between 40° and 80° with respect to said edges.

16. The tape of claim 8 wherein said angularity gives an appearance of angles between 40° and 80° with respect to said edges.

17. The tape of claim 1 wherein said tape comprises an elastic shirred web material.

18. The tape of claim 2 wherein said tape comprises an elastic shirred web material.

* * * * *